US009333499B2

(12) United States Patent
Bolliger

(10) Patent No.: US 9,333,499 B2
(45) Date of Patent: May 10, 2016

(54) PIPETTING APPARATUS

(71) Applicant: Tecan Trading AG, Mannedorf (CH)

(72) Inventor: Roland Bolliger, Richterswil (CH)

(73) Assignee: TECAN TRADING AG, Mannedorf (CH)

( * ) Notice: Subject to any disclaimer, the term of this patent is extended or adjusted under 35 U.S.C. 154(b) by 83 days.

(21) Appl. No.: 13/974,582

(22) Filed: Aug. 23, 2013

(65) Prior Publication Data

US 2014/0363355 A1 Dec. 11, 2014

(30) Foreign Application Priority Data

Jun. 6, 2013 (CH) ..... 01070/13

(51) Int. Cl.
*B01L 3/02* (2006.01)

(52) U.S. Cl.
CPC ..... *B01L 3/021* (2013.01); *B01L 3/0279* (2013.01); *B01L 2200/021* (2013.01); *B01L 2200/026* (2013.01)

(58) Field of Classification Search
None
See application file for complete search history.

(56) References Cited

U.S. PATENT DOCUMENTS

| | | | | |
|---|---|---|---|---|
| 5,525,302 | A | 6/1996 | Astle | |
| 6,024,925 | A | 2/2000 | Little et al. | |
| 2001/0012492 | A1* | 8/2001 | Acosta et al. | 422/65 |
| 2001/0048899 | A1 | 12/2001 | Marouiss et al. | |
| 2002/0086440 | A1* | 7/2002 | Lehtinen et al. | 436/180 |
| 2002/0131903 | A1 | 9/2002 | Ingenhoven et al. | |
| 2004/0050866 | A1 | 3/2004 | Ingenhoven et al. | |
| 2004/0231438 | A1* | 11/2004 | Schwartz | 73/864.17 |
| 2004/0234420 | A1* | 11/2004 | Yiu | 422/100 |
| 2005/0112776 | A1* | 5/2005 | Clark et al. | 436/180 |
| 2005/0178217 | A1* | 8/2005 | Carl | 73/863.32 |
| 2005/0244303 | A1* | 11/2005 | Ingenhoven et al. | 422/100 |
| 2008/0095665 | A1* | 4/2008 | Smith | 422/58 |
| 2008/0253933 | A1* | 10/2008 | Redfern | 422/100 |
| 2009/0293643 | A1* | 12/2009 | Powell et al. | 73/863.01 |
| 2010/0129789 | A1* | 5/2010 | Self et al. | 435/5 |
| 2011/0306053 | A1* | 12/2011 | Ochsenbein et al. | 435/6.12 |
| 2011/0318241 | A1* | 12/2011 | Danehy et al. | 422/500 |

(Continued)

FOREIGN PATENT DOCUMENTS

| | | |
|---|---|---|
| EP | 1136127 A2 | 9/2001 |
| WO | 91/12077 | 8/1991 |

(Continued)

OTHER PUBLICATIONS

European Search Report for EP13181354.

*Primary Examiner* — Jill Warden
*Assistant Examiner* — Benjamin Whatley
(74) *Attorney, Agent, or Firm* — Notaro, Michalos & Zaccaria P.C.

(57) ABSTRACT

Pipetting apparatus has a block for holding pipette tips and connecting to pipette cones of a multiple-pipette head of a liquid handling apparatus. The block has cavities in an array and pipette tips inserted therein as well as conical plug-in openings for pipette cones of a multiple-pipette head. The block additionally has devices for connecting the block and the head. The block has receptacles with a shoulder and inserts for inserting into the receptacles, insert having a cavity, a cylindrical insertion opening with inserted pipette tip and a conical plug-in opening for sealing introduction of a pipette cone. Each insert has a support with which it rests on the shoulder of a corresponding receptacle when inserted into the block. Preferably each insert lies in the corresponding receptacle of the block with horizontal play on all sides.

22 Claims, 3 Drawing Sheets

(56) References Cited

U.S. PATENT DOCUMENTS

| | | | | |
|---|---|---|---|---|
| 2012/0213677 | A1* | 8/2012 | Petrek | 422/525 |
| 2012/0258026 | A1 | 10/2012 | Naumann | |
| 2013/0068041 | A1* | 3/2013 | Naumann et al. | 73/864.01 |
| 2014/0182398 | A1* | 7/2014 | Colman | 73/863.23 |

FOREIGN PATENT DOCUMENTS

| | | | |
|---|---|---|---|
| WO | WO02160036 | A2 | 2/2002 |
| WO | WO02059626 | | 8/2002 |
| WO | 2005/007289 | | 1/2005 |
| WO | WO2008068605 | A1 | 6/2008 |

* cited by examiner

Fig. 1 Prior Art
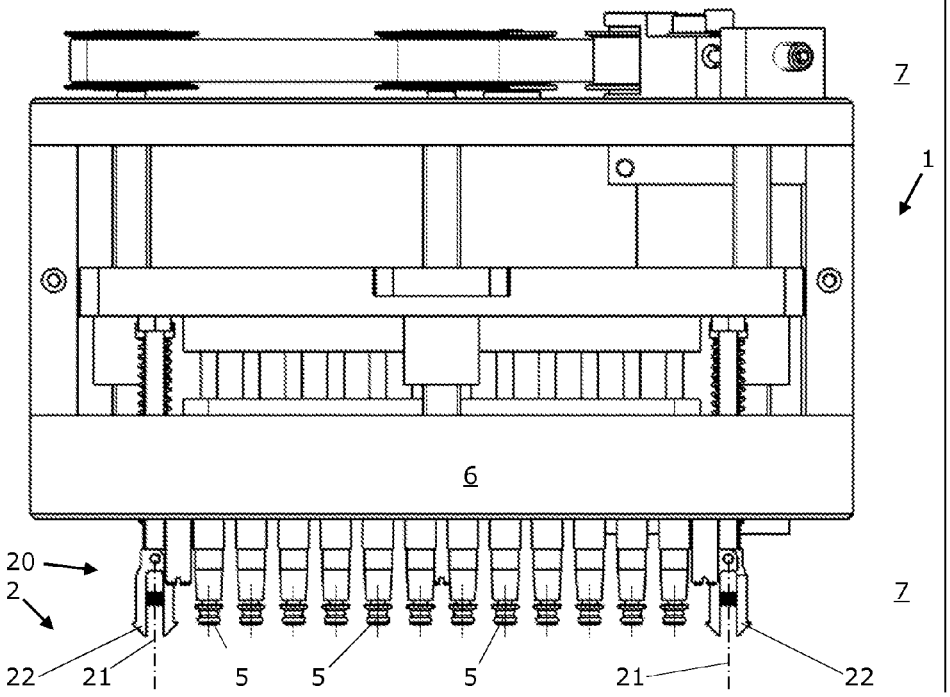
Fig. 2 Prior Art
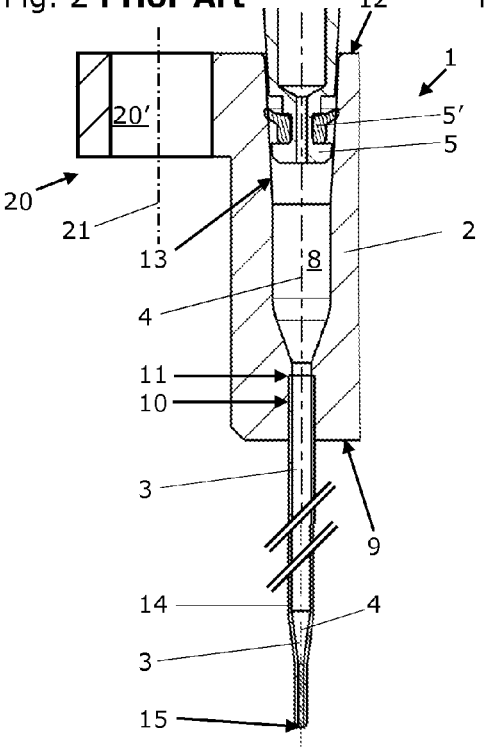
Fig. 3
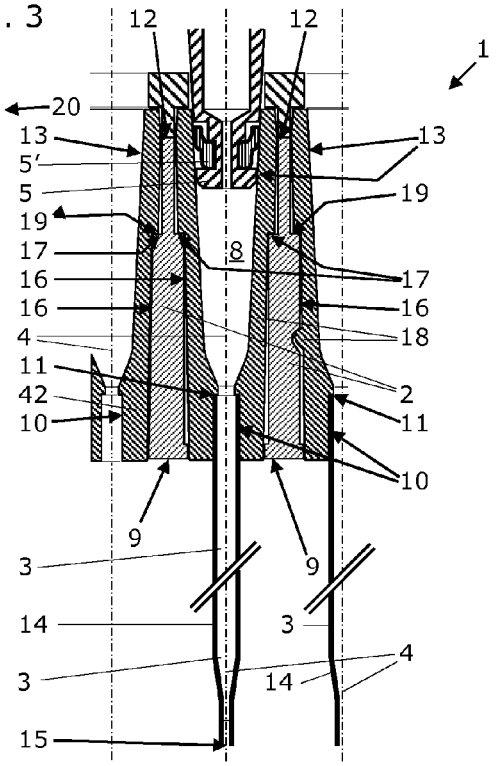

PIPETTING APPARATUS

RELATED PATENT APPLICATIONS

This patent application claims priority of the Swiss Patent Application No. CH 01070/13 of Jun. 6, 2013, the disclosure of which is herein incorporated in its entirety by explicit reverence.

RELATED FIELD OF TECHNOLOGY

The invention relates to a pipetting apparatus. Such pipetting apparatuses typically comprise a block for holding a plurality of identically configured pipette tips having a tip axis and for connecting these pipette tips to a plurality of pipette cones of a multiple-pipette head of a liquid handling apparatus. Such a block comprises a plurality of cavities penetrating the block which are disposed parallel to one another. These cavities are frequently disposed in an array which corresponds to the arrangement of wells of a standard microplate. Such a block additionally comprises a plurality of cylindrical insertion openings disposed on an underside of the block and forming a lower opening of the cavities. These insertion openings are configured in such a manner for the frictional receipt of respectively one pipette tip that the tip axes of all the inserted pipette tips are disposed substantially parallel to one another, e.g. in such an array. At the same time, each cylindrical insertion opening can preferably have a stop which is configured to be acted upon by a rear end of an inserted pipette tip. Such a block additionally comprises a plurality of conical plug-in openings disposed on an upper side of the block and forming an upper opening of the cavities of which each is configured for the sealing introduction of a pipette cone of a multiple-pipette head. In addition, such a pipetting apparatus typically comprises a plurality of tubular pipette tips having respectively one wall extending along the tip axis and having a transport opening disposed on a front end for receiving and dispensing liquid samples as well as devices for connecting block and multiple-pipette head. Such devices can, for example, comprise retaining openings with retaining axes for receiving retaining devices fastened to the multiple-pipette head.

RELATED PRIOR ART

Standardized standard microplates (cf. e.g. the standard ANSI_SBS 1-2-3-4-2004) are known and have arrays of wells which, for example, are arranged at an axial spacing of 9 mm (96-well microplate) or of 4.5 mm (384-well microplate).

When conducting more complex series of experiments or assays, so-called wall effects sometimes occur in microplates, i.e. in the outermost wells of a 96-well microplate, results differing from the central wells can be obtained. For this reason the standards and controls are frequently placed in wells located in central rows or columns of a microplate. However this pipetting pattern is very expensive and time-consuming to process and in addition, e.g. when using 96-well microplates, it cannot be serviced with a multiple-pipette head and a conventional block with 96 channels; normally an 8-channel pipetter is used for this. In conventional blocks having a plurality of, for example, 96 or 384 pipette tips, no specific subregions of the entire tip array can be used without pipette tips not belonging to this array, for example, being more or less brutally removed with "converted blocks". It therefore arises that a first "converted block" is used for pipetting the standard, a second "converted block" is used for pipetting the controls and a third "converted block" is used for pipetting the samples in the arrays provided for this. If several of the 96 or 384 pipette tips or only a single pipette tip of one block having for example 96 or 384 channels is damaged by a collision with a labware article (e.g. with a microplate), these pipette tips must be inconveniently replaced by a service specialist.

OBJECT AND SUMMARY OF THE PRESENT INVENTION

It is the object of the present invention to provide an alternative pipetting apparatus having a block for holding a plurality of identically configured pipette tips which eliminates disadvantages of conventional blocks known from the prior art.

This object is solved with a pipetting apparatus according to the feature combination as herein disclosed. This pipetting apparatus comprises:

a) a block for holding a plurality of identically configured pipette tips having a tip axis and for connecting these pipette tips to a plurality of pipette cones of a multiple-pipette head of a liquid handling apparatus, wherein the block comprises:
   i) a plurality of cavities penetrating the block which are disposed parallel to one another;
   ii) a plurality of cylindrical insertion openings disposed on an underside of the block and forming a lower opening of the cavities, which are configured in such a manner for the frictional receipt of respectively one pipette tip that the tip axes of all the inserted pipette tips are disposed substantially parallel to one another; and
   iii) a plurality of conical plug-in openings disposed on an upper side of the block and forming an upper opening of the cavities, of which each is configured for the sealing introduction of a pipette cone of a multiple-pipette head;
b) a number of tubular pipette tips each having a wall extending along the tip axis and having a transport opening disposed at a front end for receiving and dispensing liquid samples; and
c) devices for connecting block and multiple-pipette head.

The pipetting apparatus according to the invention is characterized in that it additionally comprises:

d) a plurality of receptacles extending concentrically to the tip axes, penetrating the block, each of which has a shoulder; and
e) a plurality of inserts extending concentrically to the tip axes for insertion into the receptacles of the block, wherein each insert comprises a cavity, a cylindrical insertion opening with inserted pipette tip and a conical plug-in opening for the sealing introduction of a pipette cone of a multiple-pipette head, wherein each insert has a support with which, when inserted into the block, it rests on the shoulder of the corresponding receptacle.

It is especially preferred that each insert lies in the corresponding receptacle of the block with horizontal play on all sides. It is particularly preferred that the pipette tips and as a result also the cavities are arranged in an array that corresponds to the arrangement of wells of a standard microplate. In addition, it is preferred that each cylindrical insertion opening has a stop which is configured for being acted upon by a rear end of an inserted pipette tip.

Preferably the pipetting apparatus according to the invention additionally comprises:

f) a retaining apparatus for preventing an undesired withdrawal of an insert from a receptacle during separation of block and multiple-pipette head.

Advantages of the pipetting apparatus according to the invention comprise:

- Most diverse arrays of pipette tips can be freely configured and changed again with the same block so that any patterns of well distributions in microplates can be processed.
- Defective and clogged pipette tips can be simply dismantled by anyone and replaced by new pipette tips.
- The pipetting apparatus according to the invention can be used for pipetting of assays using standards and controls which is particularly interesting in screening assays in biotechnology and in the pharmaceutical industry.
- In compound management in large pharmaceutical companies these freely configurable fixed-tip blocks can be used to produce mother and daughter plates.
- Washable, freely configurable fixed-tip blocks constitute a cost-saving competitor to the use of correspondingly many disposable pipette tips or throw-away pipette tips.

BRIEF INTRODUCTION OF THE ATTACHED DRAWINGS

Known pipetting apparatus and those according to the invention are described in detail with reference to exemplary embodiments shown in the schematic drawings, where these drawings are not intended to restrict the scope of the disclosure. In the figures:

FIG. 1 shows a view of a multiple-pipette head known from the prior art;

FIG. 2 shows a vertical partial section through a block known from the prior art for holding identically configured pipette tips;

FIG. 3 shows a vertical partial section through a block according to the invention for holding identically configured pipette tips;

DETAILED DESCRIPTION OF THE PRIOR ART

Figure 4:
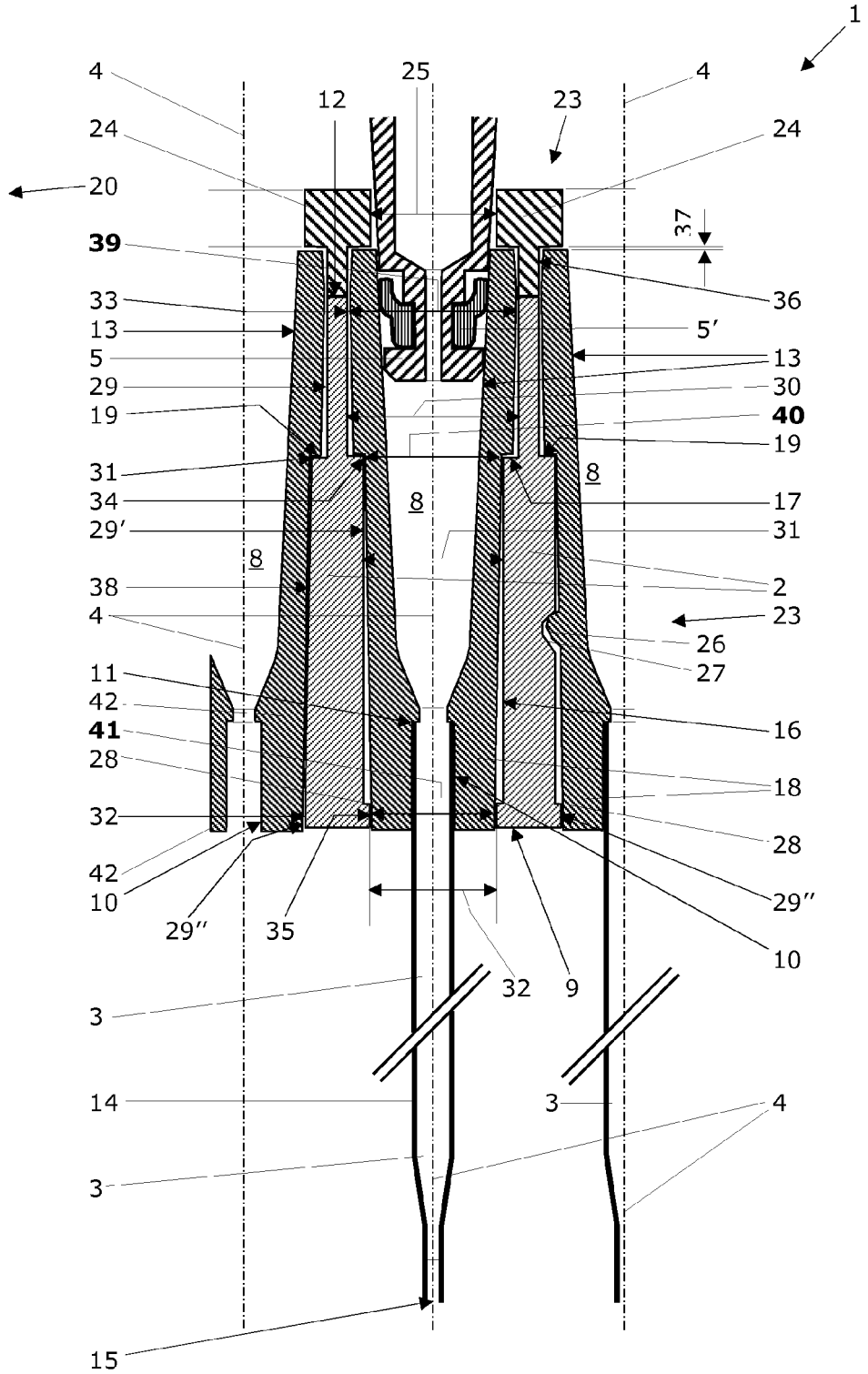
FIG. 4 shows an enlarged view of the vertical partial section from FIG. 3.

FIG. 1 shows a view of a multiple-pipette head 6 of a liquid handling apparatus 7 known from the prior art. Such a liquid handling apparatus 7 known from the prior art comprises a pipetting apparatus 1. This pipetting apparatus 1 comprises a block 2 (cf. FIG. 2) for holding a plurality of identically configured pipette tips 3 having a tip axis 4 and for connecting these pipette tips 3 to a plurality of pipette cones 5 of a multiple-pipette head 6 of this liquid handling apparatus 7. Such liquid handling apparatuses are known, for example, under the trade name "FREEDOM EVO®" and are manufactured and distributed by the current applicant.

FIG. 2 shows a vertical partial section through a block 2 known from the prior art for holding identically configured pipette tips 3. The block 2 known from the prior art comprises a plurality of cavities 8 penetrating the block 2 which in this case are disposed parallel in an array which corresponds to the arrangement of wells of a standard microplate.

This block 2 additionally comprises a plurality of cylindrical insertion openings 10 disposed on an underside 9 of the block 2 and forming a lower opening of the cavities 8. These insertion openings 10 are configured for the frictional receipt of respectively one pipette tip 3 in such a manner that the tip axes 4 of all the inserted pipette tips 3 are disposed substantially parallel to one another in this array. At the same time in this case each insertion opening 10 has a stop 11 which is configured for being acted upon by a rear end of an inserted pipette tip 3. The positive action of the stop 11 in the cylindrical insertion opening 10 ensures that the transport openings 15 of the pipette tips 3, which all have precisely the same length within the dimensional accuracy of the manufacturing process, lie in one plane. Thus, an exact height position of the transport openings 15 of all the pipette tips 3 can be set with a liquid handling robot (not shown) of the liquid handling apparatus 7 during the pipetting (in particular during the aspirating) of liquids.

Unlike the insertion just described, the pipette tips 3 which all have precisely the same length within the dimensional accuracy of the manufacturing process could be lowered frictionally with the aid of a gauge in a cylindrical insertion opening 10 which has no stop 11.

This block 2 further comprises a plurality of conical plug-in openings 13 disposed on an upper side 12 of the block and forming an upper opening of the cavities 8. Each of these conical plug-in openings 13 is configured for the sealing introduction of a pipette cone 5 of a multiple-pipette head 6 (cf. FIG. 1). The pipette cone 5 typically comprises a seal 5' which abuts sealingly against a conical insertion opening 13 usually in an elastically deformed manner.

Such a pipetting apparatus 1 known from the prior art additionally comprises a number of tubular pipette tips 3 each having a wall 14 extending along the tip axis 4 and having a transport opening 15 disposed at a front end for receiving (aspirating) and delivering (dispensing) liquid samples.

Such a pipetting apparatus 1 known from the prior art also comprises devices 20 for connecting block 2 and multiple-pipette head 6. An exemplary device 20 is shown in FIGS. 1 and 2. This device 20 comprises retaining openings 20' with retaining axes 21 for receiving retaining devices 22 fastened to the multiple-pipette head 6.

DETAILED DESCRIPTION OF THE PRESENT INVENTION

FIG. 3 shows a vertical partial section through a block 2 according to the invention for holding identically configured pipette tips 3 in an enlargement comparable to FIG. 2. A pipetting apparatus 1 according to the invention comprises at least one such block 2 for holding a plurality of identically configured pipette tips 3 having a tip axis 4 and for connecting these pipette tips 3 to a plurality of pipette cones 5 of a multiple-pipette head 6 of a liquid handling apparatus 7. Preferably each pipette cone 5 comprises a seal 5' which is designed so that during penetration of the pipette cone 5 into a conical plug-in opening 13, said seal is elastically deformed and abuts sealingly against these conical plug-in openings 13.

The block 2 according to the invention comprises a plurality of cavities 8 penetrating the block 2 which are disposed parallel in an array which corresponds to the arrangement of wells of a standard microplate. The block 2 according to the invention additionally comprises a plurality of cylindrical insertion openings 10 disposed on an underside 9 of the block 2 and forming a lower opening of the cavities 8. These cylindrical insertion openings 10 are configured in such a manner for the frictional receipt of respectively one pipette tip 3 that the tip axes 4 of all the inserted pipette tips 3 are disposed substantially parallel to one another in this array. In a block 2 which for example is adapted to the standard ANSI_SBS 1-2-3-4-2004, the tip axes 4 of the pipette tips 3 are arranged in an orthogonal grid having a grid constant of 9 mm (for 96-well microplates) or having a grid constant of 4.5 mm (for 384-well microplates). If the block 2 is adapted to a different standard for microplates, the arrangement of the tip axes 4 of the pipette tips 3 is determined according to that standard. In each case, each of the cylindrical insertion openings 10 preferably has a stop 11 which is configured for being acted upon by a rear end of an inserted pipette tip 3.

The block 2 according to the invention further comprises a plurality of conical plug-in openings 13 disposed on an upper side 12 of the block 2 and forming an upper opening of the cavities 8, each of which is configured for the sealing introduction of a pipette cone 5 of a multiple-pipette head 6.

A pipetting apparatus 1 according to the invention additionally comprises a number of tubular pipette tips 3 each having a wall 14 extending along the tip axis 4 and having a transport opening 15 disposed at a front end for receiving and dispensing liquid samples. A pipetting apparatus 1 according to the invention also comprises devices 20 for connecting block 2 and multiple-pipette head 6. These devices 20 can comprise retaining openings 20' with retaining axes 21 for receiving retaining devices 22 fastened to the multiple-pipette head 6 or can be configured differently.

A pipetting apparatus 1 according to the invention additionally comprises a plurality of receptacles 16 preferably disposed in this array and extending concentrically to the tip axes 4, penetrating the block 2, each of which has a shoulder 17. A pipetting apparatus 1 according to the invention additionally comprises a plurality of inserts 18 preferably arranged in this array (corresponding to a standard) and extending concentrically to the tip axes 4 for plugging into the receptacles 16 of the block 2. In this case, each insert 18 comprises a cavity 8, a cylindrical insertion opening 10 with inserted pipette tip 3 and a conical insertion opening 13 for the sealing introduction of a pipette cone 5 of a multiple-pipette head 6. Each insert 18 has a support 19 with which it rests on the shoulder 17 of the corresponding receptacle 16 when inserted into the block 2.

FIG. 4 shows an enlarged view of the vertical partial section from FIG. 3 whereby the individual elements of the pipetting apparatus 1 according to the invention can be better identified.

Each insert 18 preferably lies in the corresponding receptacle 16 of the block 2 with horizontal play on all sides. Preferably as shown, the pipette tips 3 and as a result also the cavities 8 are arranged in an array which corresponds to the arrangement of wells of a standard microplate. Preferably each of the inserts 18 is configured as an injection-molded plastic part and each tubular pipette tip 3 is configured as a metal cannula. Preferably as shown, each cylindrical insertion opening 10 has a stop 11 which is configured for being acted upon by a rear end of an inserted pipette tip 3.

During a separation of block 2 and multiple-pipette head 6, the static friction of up to 96 or 384 seals 5' of the pipette cones 5 of a multiple-pipette head 7 used must be overcome. Since it is specially preferred that each insert lies in the corresponding receptacle 16 of the block 2 with horizontal play on all sides, during separation of block 2 and multiple-pipette head 6 all inserts 18 provided would be raised from the block 2. This lifting of the pipette tips 3 out from the block 2 can be tolerated or not. If this lifting of the pipette tips 3 out from the block 2 is to be prevented, either the static friction of each individual seal 5' or the sum of all seals 5' present must be counteracted if the block 2 is to be separated from the multiple-pipette head 6 used. For this reason, the pipetting apparatus 1 according to the invention preferably comprises a restraining apparatus 23 for preventing an undesired withdrawal of an insert 18 from a receptacle 16 during separation of block 2 and multiple-pipette head 6.

In a first preferred embodiment of the pipetting apparatus 1, the restraining apparatus 23 is configured as a cover 24 (cf. FIG. 3). Here the cover 24 can be fixed on the block 2 with inserted inserts 18 in such a manner that each of these inserts 18 is held in the corresponding receptacle 16 of the block 2 with horizontal and vertical play on all sides. This cover 24 comprises a plurality of openings 25 which are disposed in the same array as the receptacles 16 of the block 2. In addition, each of these openings 25 is configured to be freely penetratable with a pipette cone 5 of a multiple-pipette head 6.

In a second embodiment of the pipetting apparatus 1, the restraining apparatus 23 is configured as a rib/groove combination 26,27. In a first variant each of the inserts 18 comprises an at least partially circumferential rib 26 and each of the receptacles 16 of the block 2 comprises a corresponding at least partially circumferential groove 27. The rib 26 of an insert 18 inserted into the block 2 snaps into this groove 27 and thus holds this insert 18 without play in the corresponding receptacle 16 of the block 2 (cf. right side in FIG. 3). In a second variant each of the inserts 18 comprises a partially circumferential groove 27 and each of the receptacles 16 of the block 2 comprises a corresponding at least partially circumferential rib 26. The rib 26 snaps in this groove 27 of an insert 18 inserted into the block 2 and thus holds this insert 18 without play in the corresponding receptacle 16 of the block 2.

As a main difference between the two embodiments of the restraining apparatus 23 it can be mentioned that in the first embodiment with cover 24 the pipette tips 3 are only aligned parallel in the precise array by the inserting of the pipette cone 5 into the conical plug-in opening 13. On the other hand the pipette tips 3 in the second embodiment with rib/groove combination 26,27 are aligned parallel in the precise array by the mutual snapping-in of rib 26 and groove 27.

Preferably the receptacles 16 of the block 2 for insertion of the pipette tips 3 are multiply stepped, where the shoulder 17 forms a first step and a second step 28 is disposed close to the underside 9 of the block 2. In particular, it is preferred that the shoulder 17 is disposed inside the block 2 on a level which is located closer to the upper side 12 than the lower side 9 of the block 2 because a larger distance between the first and second step has a stabilizing effect on the alignment of the insert 18 and therefore on the alignment of the pipette tip 3.

A first variant of the receptacles 16 of the block 2 is preferred in which each of the receptacles 16 of the block 2 comprises three cylindrical bores 29,29',29". In this case, a first cylindrical bore 29 having a first diameter 30 extends from the upper side 12 of the block 2 as far as the shoulder 17, a second cylindrical bore 29' having a second diameter 31 extends from the shoulder 17 as far as the second step 28 and a third cylindrical bore 29" having a third diameter 32 extends from the second step 28 as far as the underside 9 of the block 2. In addition, it is preferred that each insert 18 has a first, second and third maximum diameter 39,40,41 (cf. middle of FIG. 3; the maximum diameters are marked with thicker double arrows and the corresponding reference numbers are printed in bold).

After insertion of the insert 18 into the block 2:

the first maximum diameter 39 on (or near) the surface 12 of the block 2 is smaller than the first diameter 30 of the first cylindrical bore 29 by twice a first free or gap dimension 33;

the second maximum diameter 40 at the shoulder 17 of the block 2 is smaller than the second diameter 31 of the second cylindrical bore 29' by twice a second free or gap dimension 34; and the third maximum diameter 41 at the second step 28 of the block 2 is smaller than the third diameter 32 of the third cylindrical bore 29" by twice a third free or gap dimension 35.

In a second variant of the receptacles 16 of the block 2, each of the receptacles 16 comprises two cylindrical bores 29,29". Here a first cylindrical bore 29 extends from the upper side 12 of the block 2 as far as the shoulder 17 and a further cylindrical bore 29" extends from the second step 28 as far as the underside 9 of the block 2. In addition, each of the receptacles 16 of the block 2 comprises a conical bore 38 which extends from the shoulder 17 as far as the second step 28. In addition, it is preferred that each insert 18 has a first, second and third maximum diameter 39,40,41.

After insertion of the insert 18 into the block 2 (as shown on the left-hand side of FIG. 4):

the first maximum diameter 39 on (or near) the surface 12 of the block 2 is smaller than the first diameter 30 of the first cylindrical bore 29 by twice a first free or gap dimension 33;

the second maximum diameter 40 at the shoulder 17 of the block 2 is smaller than the second diameter 31 of the conical bore 38 by twice a second free or gap dimension 34; and the third maximum diameter 41 at the second step 28 of the block 2 is smaller than the third diameter 32 of the further cylindrical bore 29" by twice a third free or gap dimension 35.

Preferred is a pipetting apparatus 1 in which the cover 24 below the openings 25 comprises cylindrical bores 36 which are disposed in the same array as the openings 25 of the cover 24. In this case, the cylindrical bores 36 of the cover 24 preferably have the same diameter as the first cylindrical bores 29 of the block 2. These cylindrical bores 36 of the cover 24 provide a vertical free dimension 37 with respect to each insert 18 encased in a receptacle 16 of the block 2. This free dimension can be a few hundredths to a few tenths of a millimeter and ensures that when the cover 24 is fixed (e.g. screwed) on the block 2, each of these inserts 18 is held in the corresponding receptacle 16 of the block 2 with horizontal and in particular with vertical play on all sides.

The preferred dimensions for a 96-wll block lie in the following ranges (production-dependent tolerances are not taken into account):

| | |
|---|---|
| First diameter 30 | 8.09 mm |
| Second diameter 31 | 6.61 mm |
| Third diameter 32 | 5.85 mm |
| First free or gap dimension 33 | 0.07 mm |
| Second free or gap dimension 34 | 0.08 mm |
| Third free or gap dimension 35 | 0.05 mm |
| Vertical free dimension 37 | 0.10 mm |
| First maximum diameter 39 | 7.95 mm |
| Second maximum diameter 40 | 6.45 mm |
| Third maximum diameter 41 | 5.75 mm. |

Preferably the pipetting apparatus 1 can additionally comprise one or more blind inserts 42 (cf. left-hand side of FIG. 4) for plugging into selected receptacles 16 of the block 2. Here each blind insert 42 comprises a cavity 8, an open cylindrical insertion opening 10 without inserted pipette tip 3 and a conical plug-in opening 13 for the sealing introduction of a pipette cone 5 of a multiple-pipette head 6. In addition, each blind insert 42 has a support 19 with which it rests on the shoulder 17 of the corresponding receptacle 16 inserted into the block 2. It is especially preferred that each blind insert 42 lies in the corresponding receptacle 16 of the block 2 with horizontal play on all sides.

AlMg0.4Mn0.7 is preferred as material for the block. Polyetheretherketone (PEEK) is preferred as material for the inserts 18 and for the blind inserts 42. Stainless steel is preferred as material for the pipette tips 3.

Figure 5:
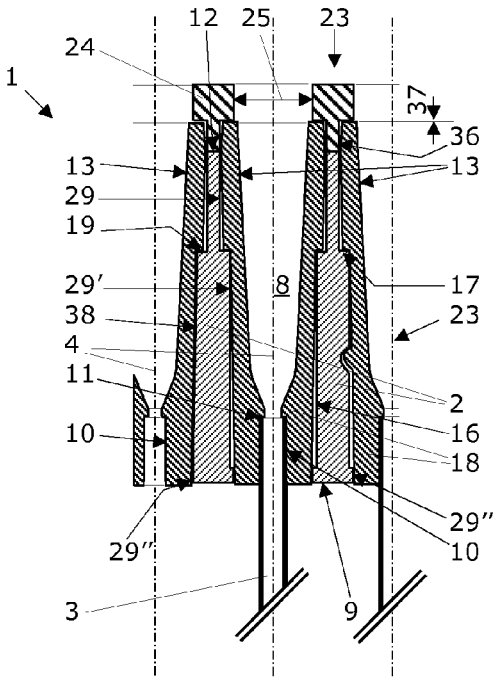
FIG. 5 shows a simplified view of FIG. 3 after removal of the multiple-pipette head and its pipette cones.

FIG. 5 shows a simplified view of FIG. 3 after the removal of the multiple-pipette head 6 and its pipette cones 5. The cover 24 of the pipetting apparatus 1 which is configured as restraining apparatus 23 and screwed onto the block here (not shown) has successfully prevented one or more inserts 18 being withdrawn from their receptacles 16 during separation of block 2 and multiple-pipette head 6. This cover 24 can preferably be fixed on the block 2 with inserted inserts 18 in a way that each of these inserts 18 is held in the corresponding receptacle 16 of the block 2 with horizontal play on all sides (which preferably corresponds to twice the first free or gap dimension 33) and vertical play (the free dimension 37). Here the cover 24 comprises a plurality of openings 25 which are disposed in the same array as the receptacles 16 of the block 2. In addition, each of these openings 25 is configured to be freely penetratable with a pipette cone 5 of a multiple-pipette head 6.

Figure 6:
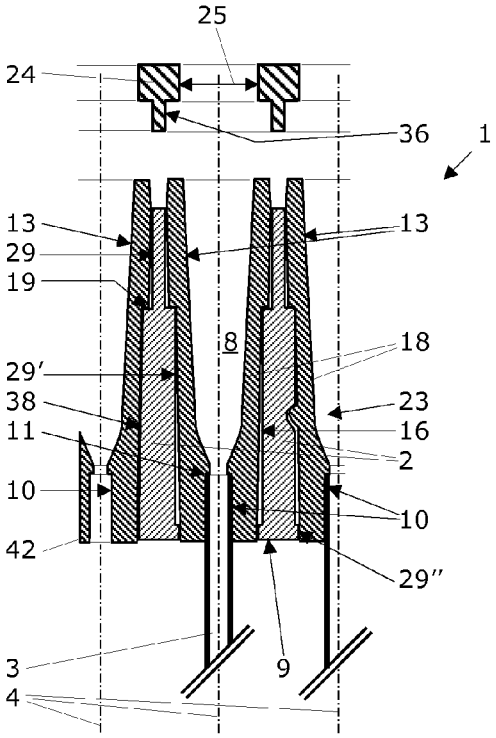
FIG. 6 shows a simplified view of FIG. 3 after removal of the multiple-pipette head and its pipette cones during rising of the cover.

FIG. 6 shows a simplified view of FIG. 3 after removal of the multiple-pipette head 6 and its pipette cones 5 during lifting of the cover 24. The individual inserts 18 can now be simply lifted from the receptacles 16 of the block 2 without expenditure of force. This lifting out can be accomplished with an instrument which has the shape and dimensions of a pipette cone 5. Such an instrument (not shown) can be moved by hand or with a robot of a liquid handling apparatus 7 (not shown) and used to remove quite specific inserts 18 with damaged pipette tips 3 or selected inserts with possibly undamaged pipette tips from the block 2.

In a method for removing pipette tips 3 from a block 2 of a pipetting apparatus 1 according to the invention which additionally has a cover 24 as a restraining apparatus 23 for preventing any undesired withdrawal of an insert 18 from a receptacle 16 during separation of block 2 and multiple-pipette head 6, the multiple-pipette head 6 and its pipette cones 5 are separated from the block 2, the cover 24 is raised from the block 2 and selected inserts 18 are lifted out from the corresponding receptacles 16.

Figure 7:
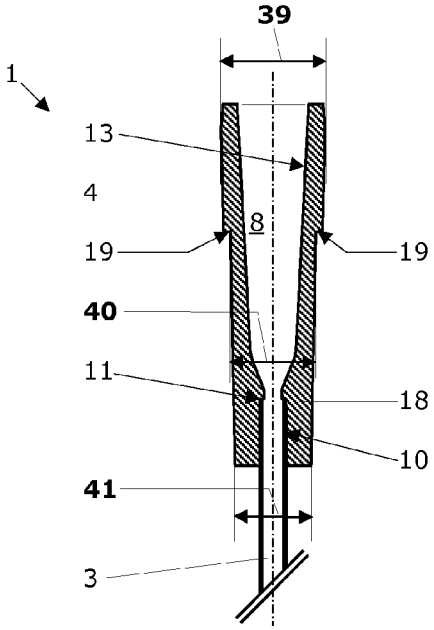
FIG. 7 shows an insert with pipette tip after lifting out from the receptacle of the block from FIG. 3.

FIG. 7 shows an insert 18 with pipetting tip 3 after lifting out from the receptacle 16 of the block 2 from FIG. 3. This diagram shows particularly clearly the first, second and third maximum diameters 39, 40, 41 of the insert 18 which are marked with thicker double arrows and at which the corresponding reference numbers are printed in bold. The cavity 8 is located in the inside of this insert and in the upper part has a conical plug-in opening 13 disposed concentric to the tip axis 4. Clearly visible here are the preferentially circumferential support 19 of the insert 18 and the pipette tip 3 of the pipetting apparatus 1 according to the invention inserted in the cylindrical insertion opening with its rear end as far as the stop 11.

Figure 8:
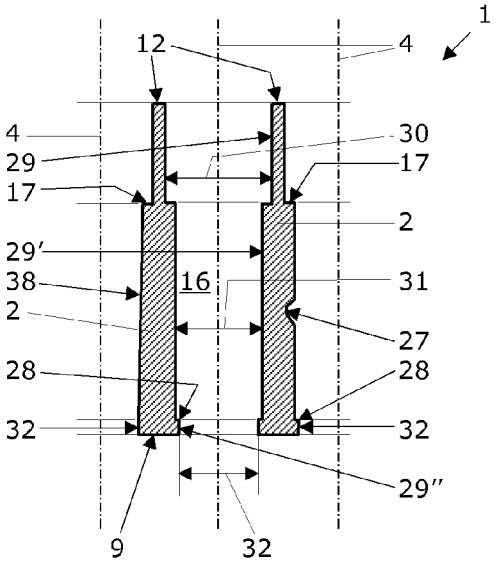
FIG. 8 shows an empty receptacle of the block from FIG. 3.

FIG. 8 shows an empty receptacle 16 of the block 2 from FIG. 3. In this diagram the first, second and third diameters 30, 31, 32 of the first, second and third cylindrical bore 29, 29', 29" of the receptacle 16 are clearly visible. Also clearly visible here are the preferably circumferential shoulder 17 of the receptacle 16 and the second step 28 near the underside 9 of the block 2 of the pipetting apparatus 1 according to the invention. The difference between the profile of the conical bore 38 (left) and the second cylindrical bore 29' (centre) in the block 2 can also be clearly seen.

In principle there are two methods for providing pipette tips 3 in a block 2 of a pipetting apparatus 1 according to the invention in which the pipette tips 3 and as a result also the cavities 8 are to be arranged in an array which corresponds to the arrangement of wells of a standard micropipette and in which the pipetting apparatus 1 additionally comprises a cover 24 as restraining apparatus 23 for preventing any undesired withdrawal of an insert 18 from a receptacle 16 during separation of block 2 and multiple-pipette head 6:

1. The cover 24 is raised from the block 2 and selected inserts 18 with their pipette tips 3 are lifted out from the corresponding receptacles 16 of the block 2. This approach is preferred if most of the inserts 18 are used and consequently only a few inserts 18 are to be removed from the block 2. A completely filled block 2 is preferably taken as the starting point. Examples of such uses are the release of wells for standards or controls.
2. The cover 24 is raised from the block 2 and selected inserts 18 with their pipette tips 3 are inserted into specific receptacles 16 of the block 2. This approach is preferred when only a few inserts 18 are used and are to be inserted into an empty block 2. Examples of such uses are the provision of pipette tips for adding standards or controls in specific wells of standard microplates.

The empty receptacles 16 can each be fitted with blind inserts 42 so that certain wells can be serviced with a conventional multiple-pipette head 6 of a liquid handling apparatus 7 and other wells of the same microplate can be bypassed in one pipetting step. Possibly a block 2 completely fitted with 96 or 384 inserts 18 and correspondingly many pipette tips 3 and an empty block 2 having an identical array of receptacles 16 are sufficient.

The same reference numbers were selected for the same features even when these features are known from the prior art or relate to the invention and even though all the details are not described in each case. Detailed reference is made to each of these reference numbers in the description of FIGS. 1 to 4. In FIGS. 5 to 7 not all reference numbers are entered any more for better clarity.

The detailed configurations of the block 2 and the inserts 18 were discussed with reference to a version with 96 pipette tips 3 which are arranged according to the standard ANSI_SBS 1-2-3-4-2004 for the use of standard microplates. These configurations also apply to blocks 2 and inserts 18 appropriately and accordingly reduced in the definitive dimensions, which are designed for the use of standard microplates with 384 wells.

| Reference list | |
|---|---|
| 1 | Pipetting apparatus |
| 2 | Block |
| 3 | Pipette tip |
| 4 | Tip axis |
| 5 | Pipette cone |
| 5' | Seal of 5 |
| 6 | Multiple-pipette head |
| 7 | Liquid handling apparatus |
| 8 | Cavity |
| 9 | Underside of block |
| 10 | Cylindrical insertion openings |
| 11 | Stop |
| 12 | Upper side, surface of block |
| 13 | Conical plug-in opening |
| 14 | Wall |
| 15 | Transport opening |

-continued

| Reference list | |
|---|---|
| 16 | Receptacle |
| 17 | Shoulder of 16 |
| 18 | Insert |
| 19 | Support of 18, 42 |
| 20 | Device for connecting 2&6 |
| 20' | Retaining opening |
| 21 | Retaining axis |
| 22 | Retaining apparatus |
| 23 | Restraining apparatus |
| 24 | Cover |
| 25 | Opening |
| 26 | Rib |
| 27 | Groove |
| 28 | Second step |
| 29 | First cylindrical bore |
| 29' | Second cylindrical bore |
| 29" | Third, further cylindrical bore |
| 30 | First diameter |
| 31 | Second diameter |
| 32 | Third diameter |
| 33 | First free dimension, gap dimension |
| 34 | Second free dimension, gap dimension |
| 35 | Third free dimension, gap dimension |
| 36 | Cylindrical bore of 23/24 |
| 37 | Vertical free dimension |
| 38 | Conical bore |
| 39 | First maximum diameter |
| 40 | Second maximum diameter |
| 41 | Third maximum diameter |
| 42 | Blind insert |

What is claimed is:

1. A pipetting apparatus (1) having a multiple pipette head (6) comprising a plurality of pipette cones (5), the pipetting apparatus comprising:

a) a block (2), the block (2) being configured:

to be connected to the multiple pipette head (6) of the pipetting apparatus (1);

for holding, through inserts (18), a plurality of identically configured pipette tips (3) having a tip axis (4), a wall (14) extending along the tip axis (4), and a transport opening (15) disposed at a front end for receiving and dispensing liquid samples; and for connecting these pipette tips (3) to the plurality of pipette cones (5) of the multiple pipette head (6);

wherein the block (2) comprises a plurality of receptacles (16) that are disposed parallel to one another and that penetrate the block (2), each receptacle (16) extending concentrically around the tip axes (4), having a shoulder (17) and being configured to receive an insert (18);

b) a plurality of inserts (18) extending concentrically around the tip axes (4) and being configured for insertion into receptacles (16) of the block (2), wherein each insert (18) comprises a cavity (8), and wherein each cavity comprises a cylindrical insertion opening (10) on a lower side of the insert for holding a pipette tip (3) inserted therein and a conical insertion opening (13) on an upper side of the insert configured for the sealing introduction of a pipette cone (5) of the multiple pipette head (6), and wherein each insert (18) comprises a support (19) which rests on the shoulder (17) of the corresponding receptacle (16), and wherein each insert (18) lies having horizontal play on all sides within the corresponding receptacle (16) upon the insert being in a receptacle (16) of the block;

c) a restraining apparatus (23) for preventing any undesired withdrawal of an insert (18) from a receptacle (16) during separation of the block (2) and the multiple pipette head (6);

d) devices (20) that are configured for connecting the block (2) and the multiple pipette head (6); and e) a plurality of pipette tips inserted into the cylindrical insertion openings of the plurality of inserts.

2. The pipetting apparatus (1) of claim 1, wherein the pipette tips (3) and as a result the cavities (8) are disposed in an array which corresponds to the arrangement of wells of a standard microplate.

3. The pipetting apparatus (1) of claim 1, wherein each of the inserts (18) is configured as an injection molded plastic part and each pipette tip (3) is configured as a metal cannula.

4. The pipetting apparatus (1) of claim 1, wherein each cylindrical insertion opening (10) has a stop (11) which is configured for being acted upon by a rear end of an inserted pipette tip (3).

5. The pipetting apparatus (1) of claim 1, wherein the restraining apparatus (23) is configured as a cover (24), wherein the cover (24) can be fixed on the block (2) with inserted inserts (18) in such a manner that each of these inserts (18) is held in the corresponding receptacle (16) of the block (2) with horizontal and vertical play on all sides, wherein the cover (24) comprises a plurality of openings (25) which are disposed in the same array as the receptacles (16) of the block (2) and wherein each of these openings (25) is configured to be freely penetrable with a pipette cone (5) of a multiple pipette head (6).

6. The pipetting apparatus (1) of claim 1, wherein the receptacles (16) of the block (2) for insertion of the pipette tips (3) are multiply stepped, and wherein the shoulder (17) forms a first step, and a second step (28) is disposed close to the underside (9) of the block (2).

7. The pipetting apparatus (1) of claim 6, wherein the shoulder (17) is disposed inside the block (2) on a level which is located closer to the upper side (12) than the lower side (9) of the block (2).

8. The pipetting apparatus (1) of claim 6, wherein each of the receptacles (16) of the block (2) comprises three cylindrical bores (29, 29', 29"), and wherein a first cylindrical bore (29) having a first diameter (30) extends from the upper side (12) of the block (2) as far as the shoulder (17), a second cylindrical bore (29') having a second diameter (31) extends from the shoulder (17) as far as the second step (28) and a third cylindrical bore (29") having a third diameter (32) extends from the second step (28) as far as the underside (9) of the block (2).

9. The pipetting apparatus (1) of claim 8, wherein each insert (18) has a first, second and third maximum diameter (39, 40, 41) which, after insertion into the block (2) on the surface (12) of the block (2) and on the shoulder (17) and on the second step (28) are smaller by a first, second and third free dimension or gap dimension (33, 34, 35) than a corresponding diameter (30, 31, 32) of the three cylindrical bores (29, 29', 29").

10. The pipetting apparatus (1) of claim 6, wherein each of the receptacles (16) of the block (2) comprises two cylindrical bores (29, 29") which extend from the upper side (12) of the block (2) as far as the shoulder (17) and from the second step (28) as far as the underside (9) of the block (2), and wherein each of the receptacles (16) of the block (2) comprises a conical bore (38) which extends from the shoulder (17) as far as the second step (28).

11. The pipetting apparatus (1) of claim 10, wherein each insert (18) has a first, second and third maximum diameter (39,40,41) which, after insertion into the block (2) on the surface (12) of the block (2) and on the shoulder (17) and on the second step (28) is smaller by a first, second and third free dimension or gap dimension (33, 34, 35) than a corresponding diameter of the cylindrical bores (29, 29") or the conical bore (38).

12. The pipetting apparatus (1) of claim 8, further comprising a cover (24) having a plurality of openings (25) there through;

wherein the cover (24) below the openings (25) comprises cylindrical bores (36) which are disposed in the same array as the openings (25) of the cover (24), wherein the cylindrical bores (36) of the cover (24) have the same diameter as the first cylindrical bores (29) of the block (2), and wherein these cylindrical bores (36) of the cover (24) provide a vertical free dimension (37) with respect to each insert (18) encased in a receptacle (16).

13. The pipetting apparatus (1) of claim 10, further comprising a cover (24) having a plurality of openings (25) there through;

wherein the cover (24) below the openings (25) comprises cylindrical bores (36) which are disposed in the same array as the openings (25) of the cover (24), wherein the cylindrical bores (36) of the cover (24) have the same diameter as the first cylindrical holes (29) of the block (2), and wherein these cylindrical bores (36) of the cover (24) provide a vertical free dimension (37) with respect to each insert (18) included in a receptacle (16).

14. The pipetting apparatus (1) of claim 1, wherein the devices (20) for connecting the block (2) and the multiple pipette head (6) comprise retaining openings (20') with retaining axes (21) for receiving retaining devices (22) fastened on the multiple pipette head (6).

15. The pipetting apparatus (1) of claim 1, wherein the pipetting apparatus (1) additionally comprises one or more blind inserts (42) for plugging into selected receptacles (16) of the block (2), wherein each blind insert (42) comprises a cavity (8), an open cylindrical insertion opening (10) without inserted pipette tip (3) and a conical plug-in opening (13) for the sealing introduction of a pipette cone (5) of a multiple pipette head (6) and wherein each blind insert (42) has a support (19) with which it rests on the shoulder (17) of the corresponding receptacle (16) when inserted into the block (2).

16. Method for removing from or providing pipette tips (3) in a block (2) of the pipetting apparatus (1) of claim 1, wherein the pipetting apparatus (1) additionally comprises a cover (24) as restraining apparatus (23) that can be fixed on the block (2) with inserted inserts (18) in such a manner that with the cover (24) fixed on the block (2) each of these inserts (18) is held in the corresponding receptacle (16) of the block (2) with horizontal and vertical play on all sides, wherein the cover (24) comprises a plurality of openings (25) which are disposed in the same array as the receptacles (16) of the block (2), wherein each of these openings (25) is configured to be freely penetrable with a pipette cone (5) of a multiple pipette head (6), and wherein this cover (24) is fixed on the block (2) and thus undesired withdrawal of an insert (18) from a receptacle (16) is prevented when separating block (2) and multiple head (6).

17. Method for removing pipette tips (3) from a block (2) of a pipetting apparatus (1) according to claim 16, wherein the cover (24) is raised from the block (2) and selected inserts (18) with their pipette tips (3) are lifted out from the corresponding receptacles (16).

18. Method for providing pipette tips (3) in a block (2) of a pipetting apparatus (1) according to claim 16, wherein the cover (24) is raised from the block (2) and selected inserts (18) with their pipette tips (3) are inserted into specific receptacles (16) of the block (2).

19. A pipetting apparatus (1) having a multiple pipette head (6) comprising a plurality of pipette cones (5), the pipetting apparatus comprising:

a) a block (2), the block (2) being configured:

to be connected to the multiple pipette head (6) of the pipetting apparatus (1);

for holding, through inserts (18), a plurality of identically configured pipette tips (3) having a tip axis (4), a wall (14) extending along the tip axis (4), and a transport opening (15) disposed at a front end for receiving and dispensing liquid samples; and for connecting these pipette tips (3) to the plurality of pipette cones (5) of the multiple pipette head (6);

wherein the block (2) comprises a plurality of receptacles (16) that are disposed parallel to one another and that penetrate the block (2), each receptacle (16) extending concentrically around the tip axes (4), having a shoulder (17) and being configured to receive an insert (18);

b) a plurality of inserts (18) extending concentrically around the tip axes (4) and being configured for insertion into receptacles (16) of the block (2), wherein each insert (18) comprises a cavity (8), and wherein each cavity comprises a cylindrical insertion opening (10) on a lower side of the insert for holding a pipette tip (3) inserted therein and a conical insertion opening (13) on an upper side of the insert configured for the sealing introduction of a pipette cone (5) of the multiple pipette head (6), and wherein each insert (18) comprises a support (19) which rests on the shoulder (17) of the corresponding receptacle (16) upon the insert being in a receptacle (16) of the block;

c) a restraining apparatus (23) for preventing undesired withdrawal of an insert (18) from a receptacle (16) during separation of the block (2) and the multiple pipette head (6);

wherein the restraining apparatus (23) is configured as a rib/groove combination, (26, 27) wherein:

each of the inserts (18) comprises an at least partially circumferential rib (26), and wherein each of the receptacles (16) of the block (2) comprises a corresponding at least partially circumferential groove (27), into which the rib (26) of an insert (18) inserted into the block (2) snaps and thus holds this insert (18) without play in the corresponding receptacle (16) of the block (2); and d) a plurality of pipette tips inserted into the cylindrical insertion openings of the plurality of inserts.

20. The pipetting apparatus (1) of claim 19, wherein the pipette tips (3) and the cavities (8) are disposed in an array which corresponds to the arrangement of wells of a standard microplate.

21. The pipetting apparatus (1) of claim 19, wherein each of the inserts (18) is configured as an injection molded plastic part and each tubular pipette tip (3) is configured as a metal cannula.

22. The pipetting apparatus (1) of claim 19, wherein each cylindrical insertion opening (10) has a stop (11) which is configured for being acted upon by a rear end of an inserted pipette tip (3).

* * * * *